US007571995B2

(12) United States Patent
Chung et al.

(10) Patent No.: US 7,571,995 B2
(45) Date of Patent: Aug. 11, 2009

(54) INK CARTRIDGE REFILL SYSTEM FOR INKJET PRINTERS AND METHOD OF REFILLING INK CARTRIDGES USING THE SAME

(75) Inventors: Kwang Choon Chung, Seoul (KR); In Ha Kim, Gunpo-si (KR); Hyung Ho Gil, Siheung-si (KR); Curtis Rhodes, Albuquerque, NM (US); Jeong Guck Lee, Seongnam-si (KR); Young Choul Shin, Suwon-si (KR)

(73) Assignee: Intek Co., Ltd., Gyeonggi-Do (KR)

( * ) Notice: Subject to any disclaimer, the term of this patent is extended or adjusted under 35 U.S.C. 154(b) by 89 days.

(21) Appl. No.: 11/115,963

(22) Filed: Apr. 27, 2005

(65) Prior Publication Data

US 2006/0244791 A1 Nov. 2, 2006

(51) Int. Cl.
*B41J 2/175* (2006.01)

(52) U.S. Cl. ..... 347/85; 347/84

(58) Field of Classification Search ..... 347/85, 347/86, 22, 25, 27, 28, 30, 84
See application file for complete search history.

(56) References Cited

U.S. PATENT DOCUMENTS

D347,271 S * 5/1994 Inda et al. ..... D23/263
6,640,843 B2 * 11/2003 Lee ..... 141/18
6,685,290 B1 * 2/2004 Farr et al. ..... 347/7
6,767,075 B1 * 7/2004 Takada et al. ..... 347/19
2005/0078144 A1 * 4/2005 Yamada et al. ..... 347/30

FOREIGN PATENT DOCUMENTS

KR 2003069596 A * 8/2003
WO WO-2004/091920 A1 * 10/2004

* cited by examiner

*Primary Examiner*—Matthew Luu
*Assistant Examiner*—Henok Legesse
(74) *Attorney, Agent, or Firm*—The Webb Law Firm

(57) ABSTRACT

Disclosed herein is an ink cartridge refill system for inkjet printers and a method of refilling ink cartridges using the system. The refill system includes a vacuum pump to supply ink from an ink tank into a cylinder and to forcibly draw ink from an ink cartridge, as well as an air compression pump to generate a compression force to inject ink from the cylinder into the ink cartridge through the nozzle of the cartridge. The cylinder is connected at the inlet end thereof to both the air compression pump and the vacuum pump, and is connected at the outlet end to both the ink tank and the ink cartridge. Both a compression pump line and a first vacuum pump line which pass through the cylinder are connected to the nozzle of the cartridge through an ink supply hose. The vacuum pump includes a second vacuum pump line directly connected to the ink cartridge, as is the first vacuum pump line passing through the cylinder. Both the ink supply hose and the second vacuum pump line are connected to the nozzle of the cartridge through a connection unit. The refill system can regulate the inner pressure of a refilled cartridge by removing predetermined small amounts of air and ink from the refilled cartridge, and can completely remove waste ink from the cartridge at the initial stage of a cartridge refill process when necessary.

10 Claims, 9 Drawing Sheets

Prior Art

Prior Art

Prior Art

Prior Art

INK CARTRIDGE REFILL SYSTEM FOR INKJET PRINTERS AND METHOD OF REFILLING INK CARTRIDGES USING THE SAME

BACKGROUND OF THE INVENTION

1. Field of the Invention

The present invention relates generally to an ink cartridge refill system for inkjet printers and method of refilling ink cartridges using the system.

2. Description of the Related Art

Most users of inkjet printers prefer to refill and reuse ink cartridges rather than use new ink cartridges because the new ink cartridges are expensive. In an effort to satisfy the above-mentioned preference of the users of inkjet printers, some ink cartridge manufacturers have proposed and marketed ink cartridges that are provided with refill nozzles to allow users to refill ink cartridges through the refill nozzles.

Korean Patent Laid-open Publication No. 10-2003-69596, which was published on Aug. 27, 2003, discloses a conventional ink cartridge refill system that is configured as a refill system to be used by someone in the business of refilling customers' ink cartridges. The above-mentioned refill system is constructed such that an ink cartridge is loaded in a cartridge loading unit and is refilled with ink simply by manipulating a control switch of the cartridge loading unit.

Herein below, the conventional ink cartridge refill system 100, disclosed in the above-mentioned Korean Patent Laid-open Publication Gazette, will be described with reference to FIGS. 1 through 4.

As shown in FIG. 1, the conventional ink cartridge refill system 100 includes a plurality of cartridge loading units 110 in each of which an ink cartridge (not shown) to be refilled with ink is loaded. The refill system 100 also includes a plurality of ink reservoirs 120 to inject ink, temporarily contained therein, into ink cartridges loaded in the cartridge loading unit 110 through a plurality of ink injection hoses 101, and an ink tank 140 which stores ink therein and supplies ink to the ink reservoirs 120 through a plurality of ink supply hoses 102. Furthermore, a plurality of pressure cylinders 130 is connected to an air compression pump 150 through a plurality of air hoses.

The above-mentioned refill system 100 is operated as follows. When a control switch 104 is turned on after completely loading an ink cartridge into a cartridge loading unit 110, pressurized air from the air compression pump 150 is introduced into the pressure cylinders 130 associated with the cartridge loading unit 110, so that air pressure acts on the pistons (not shown) in the cylinders 130. Thus, the interior of the ink reservoir 120 is compressed, so that ink from the ink reservoir 120 is injected into the loaded ink cartridge. When the ink cartridge has been completely refilled with ink, the pressure in the cylinders 130 is reduced, causing the pressure in the ink reservoir 120 to be reduced. As the pressure in the ink reservoir 120 becomes reduced as described above, ink is newly supplied from the ink tank 140 into the ink reservoir 120.

In the refill system 100 shown in FIG. 1, three ink supply hoses 102 and three ink injection hoses 101 are provided to supply or inject different colors of ink, which are cyan ink, magenta ink and yellow ink. A one-way valve 101*a*, 102*a* is installed in each of the three ink injection hoses 101 and three ink supply hoses 102, thus preventing ink from flowing in a reverse direction while the ink flows from the ink reservoir 120 into the loaded ink cartridge or from the ink tank 140 into the ink reservoir 120. Each of the chambers of the ink tank 140 and the ink reservoir 120 is partitioned into three storage chambers, thereby separately containing the three different colors of ink therein. Furthermore, the three pressure cylinders 130 are provided to respectively communicate with the three storage chambers of the ink reservoir 120.

As shown in FIGS. 2 and 3, each of the cartridge loading units 110 of the refill system 100 comprises a body 111 in which an ink cartridge 1 is seated, an ink injection part 112 which comes into close contact with the nozzles 2 of the cartridge 1, and a cartridge holding part 120 which is placed at the opposite end from the nozzles 2 of the cartridge 1. The cartridge holding part 120 is configured such that, when a handle 121 is rotated upwards or downwards around a joint, the rotating motion of the handle 121 is converted into rectilinear motion of a sliding bar 122 by a link 123, so that the sliding bar 122 linearly moves forwards or rearwards. A cushion member 124 is mounted to the front end of the sliding bar 122, thus protecting the ink cartridge 1 from being impacted when the cartridge 1 is loaded into the cartridge loading unit 110.

The ink injection part 112, which comes into close contact with the nozzles 2 of the ink cartridge 1, is provided with a plurality of ink injection holes 113 that respectively correspond to the nozzles 2 of the cartridge 1. The ink injection holes 113 are connected to the ink injection hoses 101 by means of a plurality of connectors 115. As shown in FIG. 4, three different colors of ink, which are cyan ink, magenta ink and yellow ink, respectively supplied through the three ink injection holes 113, are injected into the ink cartridge 1 via the three nozzles 2.

Although the above-mentioned ink cartridge refill system is advantageous in that the system refills an ink cartridge in response to simple operation of the control switch after an ink cartridge has been loaded into a cartridge loading unit, the refill system is problematic as follows. The problems experienced in the conventional ink cartridge refill system will be described herein below with reference to FIGS. 1 through 4.

When ink is injected into an ink cartridge through the nozzles of the cartridge using air pressure in the manner disclosed for the above-mentioned refill system 100, the inner pressure of the cartridge 1 has increased to a level higher than atmospheric pressure at the time that the ink cartridge refill process has been completed, due to both pressurized air and ink having been injected into the cartridge 1. Thus, if the ink cartridge 1 which has been completely refilled with ink is directly detached from the cartridge loading unit 110, the ink may be ejected by the pressure of the cartridge 1 to the atmosphere through the nozzles 2. The ejected ink messes up both the nozzles 2 and the cartridge loading unit 110.

Furthermore, the ink remaining in the gap between the nozzles 2 and the ink injection part 112 flows down and contaminates the cartridge loading unit 110.

The ink cartridges for inkjet printers have been typically classified into two types: sponge type and pack type. Particularly, the pressure of the pack-type ink cartridges must be regulated after refilling the cartridges. The regulation of the pressure of the pack-type cartridges is made necessary by the fact that an excessive amount of ink may be discharged from the cartridge and deteriorate printing quality when the cartridge is first used, as well as the fact that the ink may be ejected under pressure at the time that the refilled cartridge is detached from the cartridge loading unit 110.

In an effort to solve the above-mentioned problems, it is necessary to expel predetermined small amounts of air and ink from a refilled cartridge and to regulate the inner pressure of the cartridge when the ink cartridge refill process has been completed. However, the above-mentioned conventional ink cartridge refill system is not configured to regulate the inner pressure of ink cartridges after refilling the cartridges.

Furthermore, the above-mentioned ink cartridge refill system is not compatible with a variety of ink cartridges having different sizes and different capacities. Described in detail, when it is desired to refill an ink cartridge having a size and capacity different from those of a previously refilled cartridge, a user must change the length of the sliding bar 122 before turning on the control switch, so that the sliding bar 122 supports the cartridge with an appropriate biasing force. Furthermore, to inject an appropriate amount of ink into an ink cartridge loaded in the cartridge loading unit, it is necessary to adjust the strokes of the pistons in the pressure cylinders 130 by adjusting a plurality of ink supply control units 131 provided on the cylinders 130.

Because the above-mentioned conventional refill system 100 is provided only with a one-way valve 101*a* in each of the ink injection hoses 101 in an effort to prevent ink from flowing in a reverse direction toward the ink reservoir 120, small amounts of ink inevitably remain in the ink injection holes 113 after an ink cartridge has been completely refilled with ink by the refill system. Thus, when the cartridge loading unit 110 having the ink injection holes 113 in which ink remains is not used for a lengthy period of time, the quality of ink remaining in the ink injection holes 113 is reduced. When the ink having the reduced quality is injected into a cartridge during a refill process, the printing quality is reduced and, furthermore, the nozzles of the cartridge may become blocked.

Typically, ink is not completely used but some ink may remain in an ink cartridge 1, so that it is sometime required to completely empty the cartridge 1 prior to refilling the cartridge 1. However, the conventional ink cartridge refill system 100 is configured such that the system 100 merely injects ink into cartridges 1 and does not automatically empty the cartridges. Thus, the user of the refill system 100 must manually empty the cartridges 1 prior to refilling the cartridges 1, so that it is inconvenient for the user to use the system 100.

SUMMARY OF THE INVENTION

Accordingly, the present invention has been made keeping in mind the above problems occurring in the prior art, and an object of the present invention is to provide an ink cartridge refill system which removes predetermined small amounts of air and ink from a refilled cartridge and regulates the inner pressure of the cartridge after an ink cartridge refill process has been completed, and which can completely remove remaining ink from the cartridge at the initial stage of the ink cartridge refill process when necessary.

Another object of the present invention is to provide an ink cartridge refill system which removes remaining ink from both the ink injection hole and the gap defined between the nozzle of the ink cartridge and the ink injection hole after the ink cartridge refill process has been completed.

A further object of the present invention is to provide an ink cartridge refill system which can be operated simply by manipulating a control button.

Yet another object of the present invention is to provide an ink cartridge refill system which is configured such that a user can manage the ink cartridge refill process while viewing the entire process of refilling the ink cartridge.

Still another object of the present invention is to provide a method of refilling ink cartridges using the refill system.

In order to accomplish the above objects, the present invention provides an ink cartridge refill system which includes a vacuum pump to supply ink from an ink tank into a cylinder and to forcibly draw ink from an ink cartridge, as well as an air compression pump to generate air pressure to forcibly inject ink stored in the cylinder into the ink cartridge. In the refill system, ink is injected into the ink cartridge through the nozzle of the cartridge.

Furthermore, the cylinder is connected at the inlet end thereof to both the air compression pump and the vacuum pump, and is connected at the outlet end thereof to both the ink tank and the ink cartridge. In the refill system, both a compression pump line and a first vacuum pump line which pass through the cylinder are connected to the nozzle of the ink cartridge through an ink supply hose.

Furthermore, the vacuum pump includes a second vacuum pump line which is directly connected to the ink cartridge, as is the first vacuum pump line which passes through the cylinder. Both the ink supply hose and the second vacuum pump line are connected to the nozzle of the ink cartridge through a connection unit.

BRIEF DESCRIPTION OF THE DRAWINGS

The above and other objects, features and advantages of the present invention will be more clearly understood from the following detailed description taken in conjunction with the accompanying drawings, in which:

FIGS. 2 and 3 are side views of a cartridge loading unit constituting the conventional cartridge refill system shown in FIG. 1, in which FIG. 2 shows a first state wherein an ink cartridge has not been completely loaded in the cartridge loading unit, and FIG. 3 shows a second state wherein the cartridge has been completely loaded in the cartridge loading unit;

FIGS. 8 and 9 are views of the cartridge loading unit shown in FIG. 6, in which FIG. 8 is a side view, and FIG. 9 is a bottom view;

DESCRIPTION OF THE PREFERRED EMBODIMENTS

Figure 1:
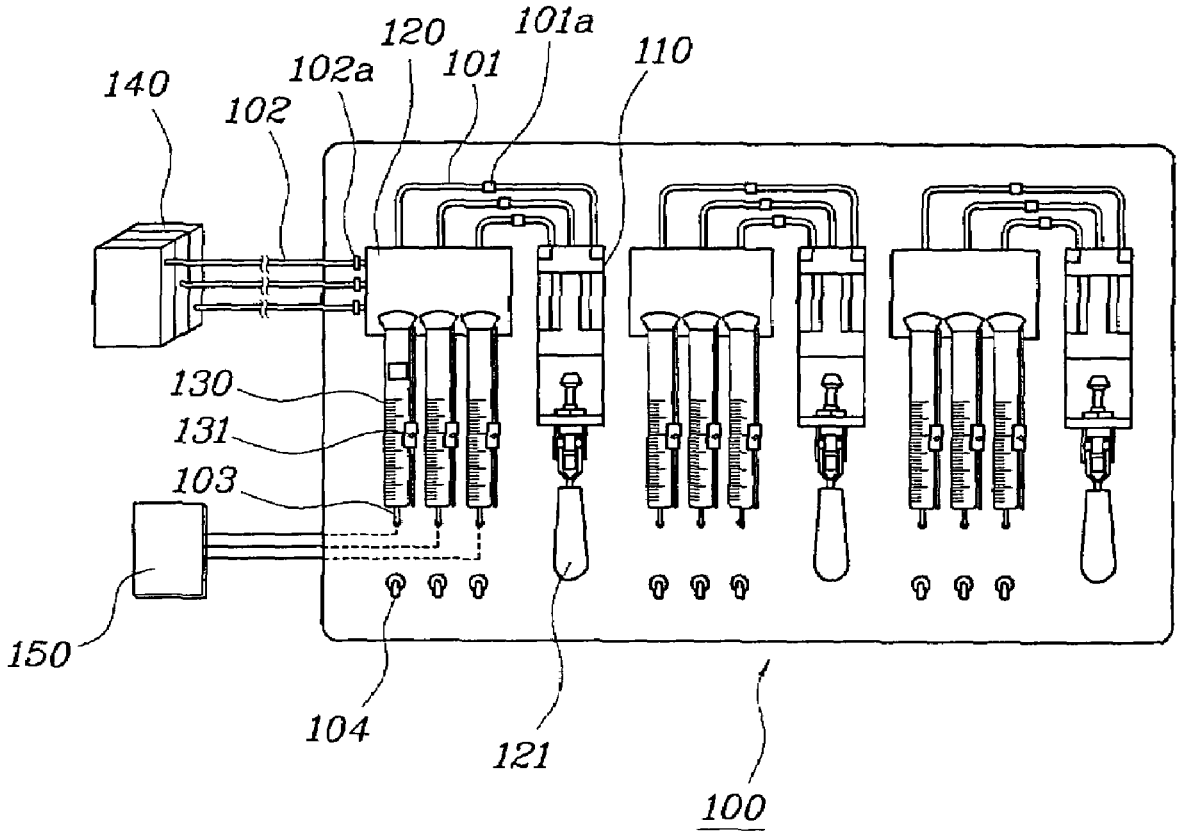
FIG. 1 is a view schematically showing the construction of a conventional ink cartridge refill system.
Figure 2:
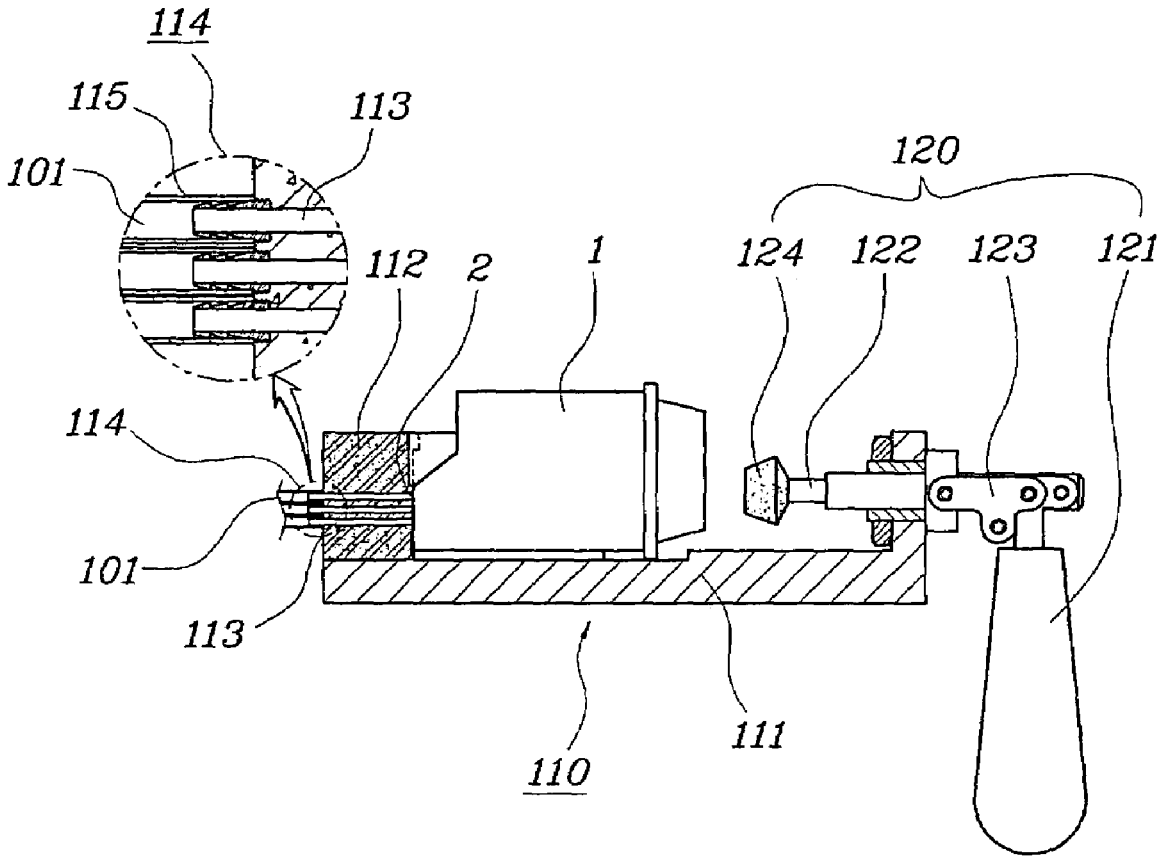
Figure 3:
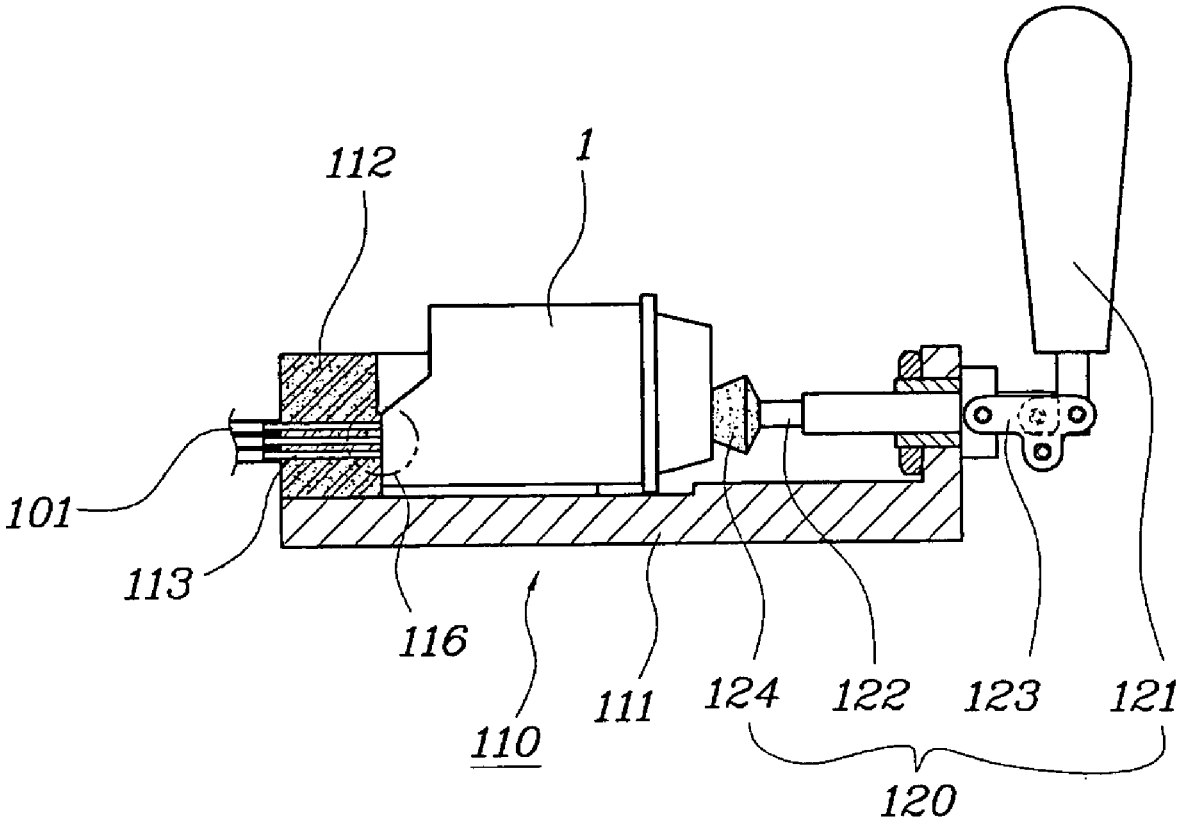

Herein below, an ink cartridge refill system according to a preferred embodiment of the present invention will be described with reference to the accompanying drawings, in which the same reference numerals are used throughout the different drawings to designate the same or similar components.

Figure 5:
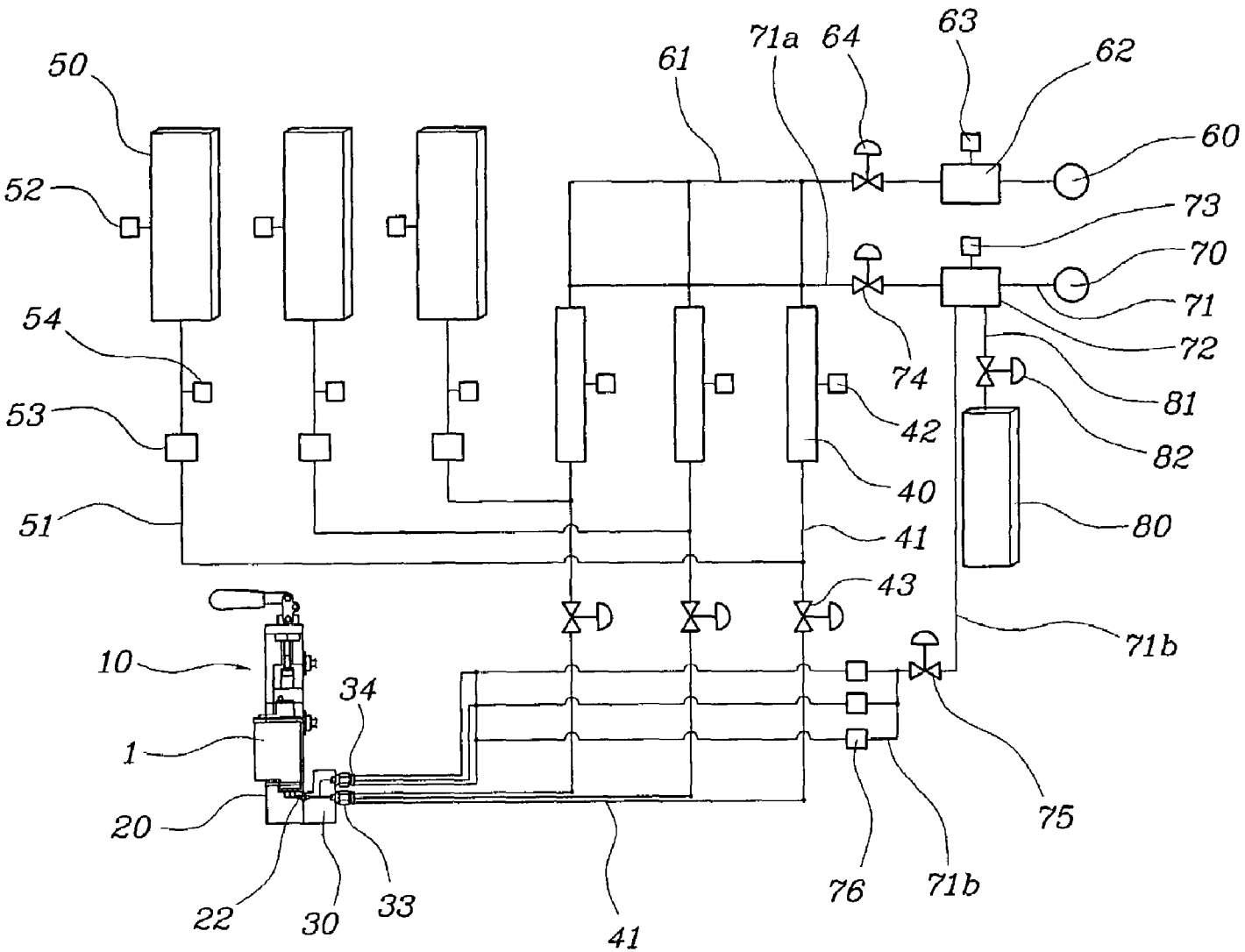
FIG. 5 is a view schematically showing the construction of an ink cartridge refill system, according to an embodiment of the present invention.
Figure 6:
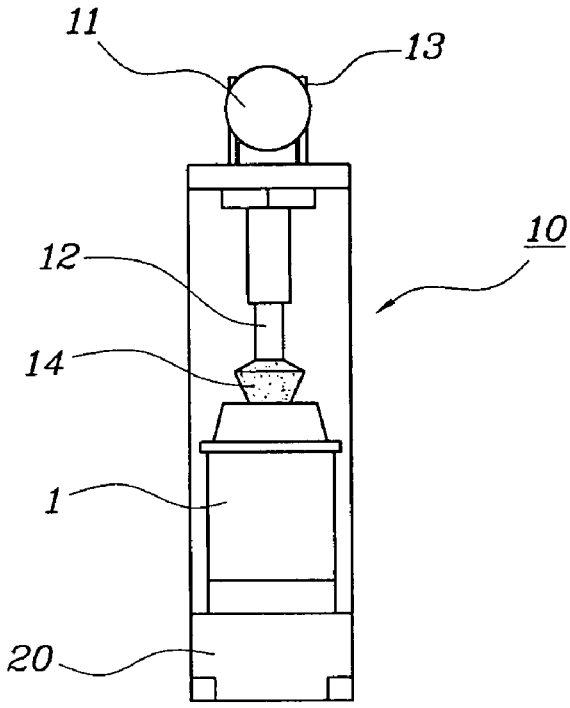
FIG. 6 is an enlarged plan view of a cartridge loading unit constituting the cartridge refill system shown in FIG. 5.

As shown in FIG. 5, the ink cartridge refill system according to an embodiment of the present invention includes a cartridge loading unit 10 in which an ink cartridge to be refilled with ink is loaded. The refill system also includes a plurality of ink tanks 50 to store therein refill ink. The refill system further includes an air compression pump 60, a vacuum pump 70, and a plurality of cylinders 40, each of which is connected at the inlet end thereof to both the compression pump 60 and the vacuum pump 70 and is connected at the outlet end thereof to both an associated ink tank 50 and a connection unit 30. The refill system further includes a plurality of hoses to connect the plurality of elements of the system to each other. The refill system further includes a plurality of sensors.

The construction of the cartridge loading unit 10 will be described herein below with reference to FIGS. 5 through 8.

Figure 4:
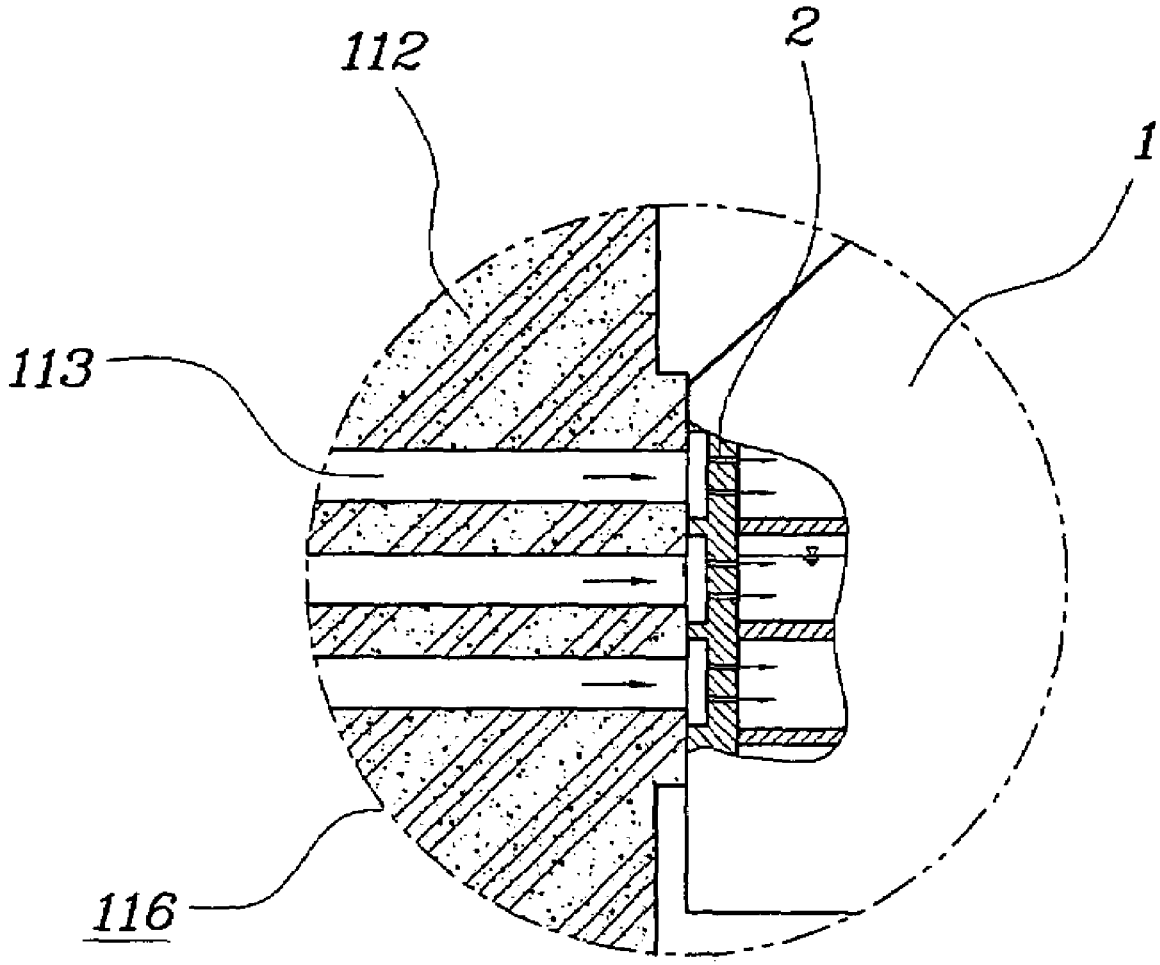
FIG. 4 is an enlarged view of the encircled portion shown in FIG. 3.

In a manner similar to that described for the conventional refill system, the cartridge loading unit 10 of the refill system comprises a body in which an ink cartridge 1 is seated, and a cartridge holding part which closely and securely seats the cartridge 1 in the cartridge loading unit 10. The cartridge holding part comprises a handle 11, a sliding bar 12, a link 13, and a cushion member 14. The nozzles 2 of the ink cartridge 1 are brought into close contact with an ink injection part 20 by the cartridge holding part comprising the above-mentioned elements 11, 12, 13 and 14, so that the nozzles 2 of the ink cartridge 1 communicate with respective ink injection holes 21 of the ink injection part 20 in the same manner as that described for the conventional refill system shown in FIG. 4.

Figure 7:
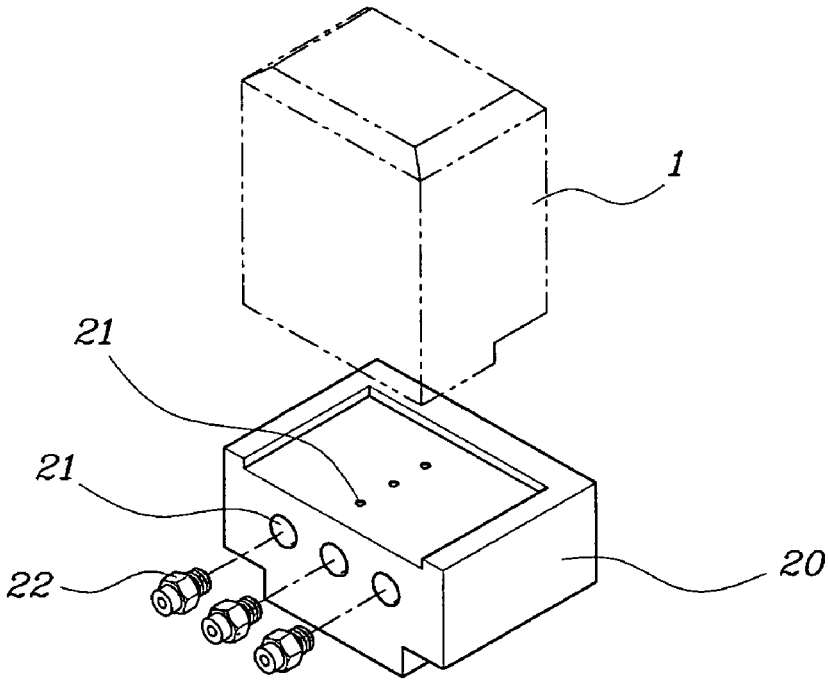
FIG. 7 is a perspective view of an ink injection part which is detached from the cartridge loading unit shown in FIG. 6.
Figure 8:
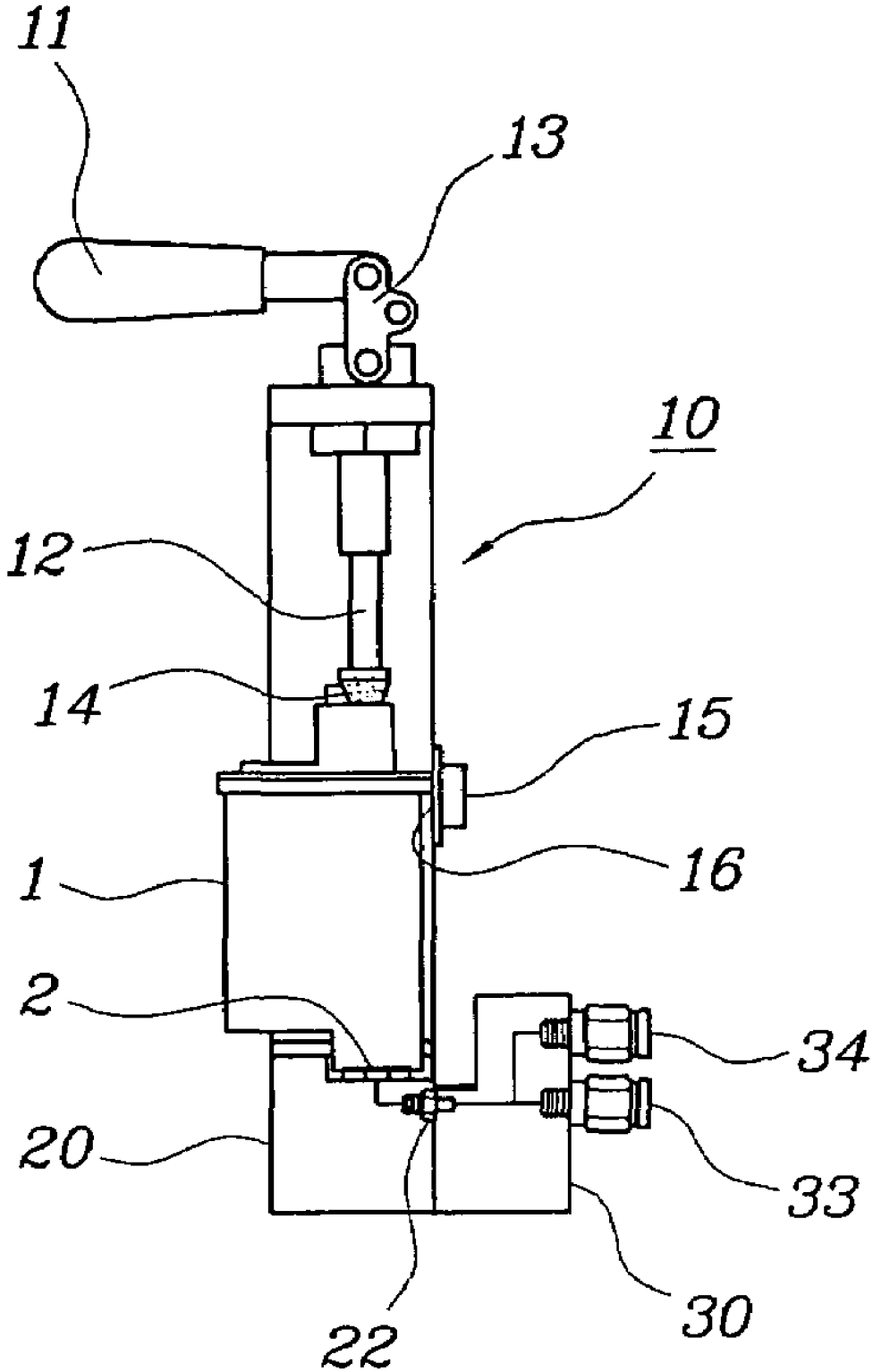

However, as shown in FIGS. 7 and 8, the inlet ports of the ink injection holes 21 are located on the rear surface of the ink injection part 20 unlike the conventional refill system. In the embodiment shown in FIG. 7, three fine ports are formed on the surface of the ink injection part 20, with which the ink cartridge 1 is brought into close contact. The three fine ports of the ink injection part 20 define the outlet ports of the three ink injection holes 21, so that the ink injection holes 21 must be bent in the ink injection part 20 (see FIG. 10).

As shown in FIG. 7, the ink injection part 20 is preferably configured such that the ink injection part 20 can be detached from the cartridge loading unit 10. Because the ink injection part 20 is detachably attached to the cartridge loading unit 10 as described above, it is possible to wash the ink injection holes 21 and to replace an existing ink injection part 20 with a new one when required.

Figure 9:
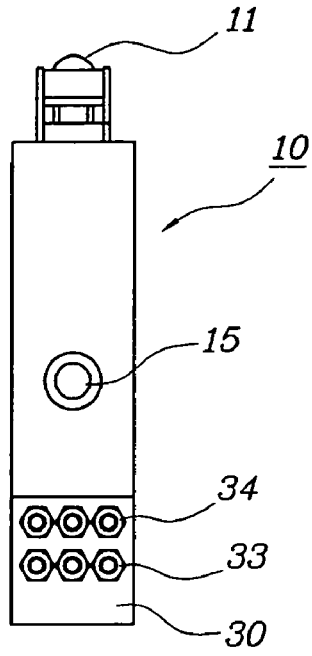

As shown in FIGS. 8 and 9, a cartridge sensor 16 is provided on each of the cartridge loading units 10 and detects whether an ink cartridge 1 is loaded in the unit 10. A lead wire to connect the sensor 16 to a control unit is inserted into a connection hole 15.

In the refill system, it is preferred to configure the cartridge loading units 10 such that a particular model of ink cartridge 1 is used with each of the units 10 by varying the widths of the cartridge seats of the units 10 and the moving lengths of the sliding bars 12.

Herein below, the connection unit 30, which is used to connect both a plurality of ink injection hoses 41 and a second vacuum hose 71*b* to the ink injection holes 21, will be described with reference to FIGS. 8 through 10.

The connection unit 30 is a body that is mounted to the rear surface of the ink injection part 20, with three ink supply holes 31 and three ink suction holes 32 formed in the connection unit 30. Of course, it should be understood that the connection unit 30 may be embodied as simple connection hoses.

The outlet ends of the three ink suction holes 32 are joined to the three ink supply holes 31, respectively, so that the three ink supply holes 31 and the three ink suction holes 32 have the same outlet ports. In the above state, it is preferred to design the join angles of the three ink suction holes 32 relative to the three ink supply holes 31 such that the join angles are 90 degrees or less. The outlet ports of the three ink supply holes 31 and the three ink suction holes 32 are connected to the ink injection holes 21 via a plurality of connectors 22.

Figure 10:
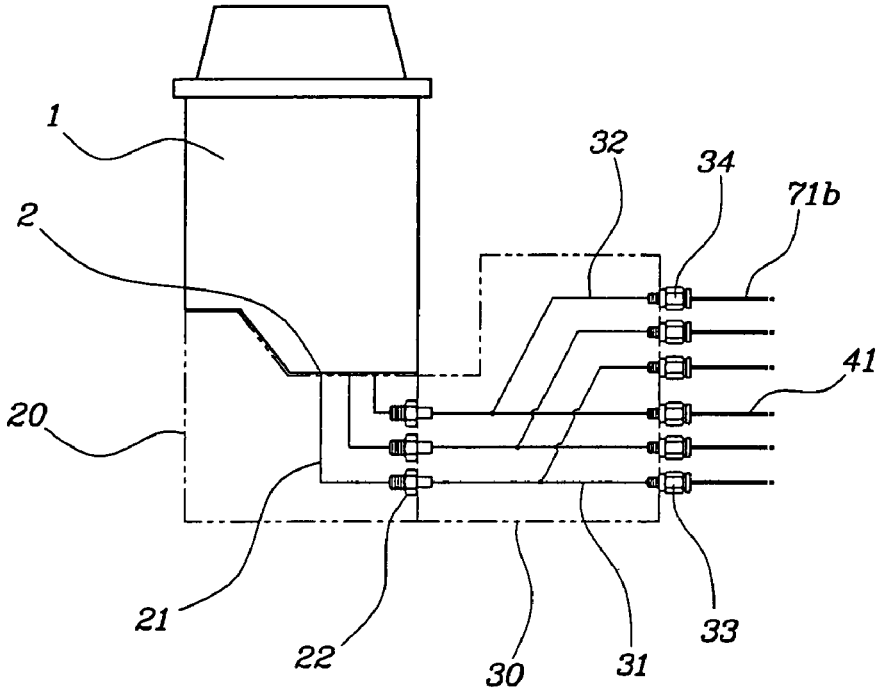
FIG. 10 is a view schematically illustrating the connection between a connection unit and the cartridge loading unit shown in FIG. 8.

As shown in FIGS. 9 and 10, the rear surface of the connection unit 30 is provided with three inlet ports of the ink supply holes 31 and three inlet ports of the ink suction holes 32. The ink injection hoses 41 are connected to the ink supply holes 31 through three connectors 33, respectively, while the branch hoses of the second vacuum hose 71*b* are connected to the ink suction holes 32 through three connectors 34, respectively.

The three above-mentioned sets of holes 21, 31 and 32 communicate with each other to form three passages through which cyan ink, magenta ink and yellow ink respectively flow. The number of holes in each set of holes 21, 31, 32 may be changed according to the number of nozzles 2 of an ink cartridge 1 to be refilled with ink or the number of colors of ink to be injected into the cartridge 1.

The construction of the other elements constituting the refill system will be described herein below with reference to FIGS. 5 and 10.

A piston (not shown) is movably placed in each of the cylinders 40, so that, when pressurized air is supplied from the air compression pump 60 into the inlet ends of the cylinders 40 through an air hose 61, the pistons move in the cylinders 40 toward the outlet ends of the cylinders 40. Thus, different colors of ink stored in the cylinders 40 are supplied to the ink supply holes 31 of the connection unit 30 through the ink injection hoses 41. An ink amount sensor 42 is provided on each of the cylinders 40 and detects the amount of ink supplied to the cylinder 40, and outputs an ink amount signal to the control unit which controls the amount of ink supplied to the cylinders 40 in response to output signals of the sensors 42.

An ink flow control valve 43 is installed in each of the ink injection hoses 41. The ink flow control valve 43 may be configured as a one-way valve, such as an ON/OFF valve or a check valve.

The ink tanks 50 are respectively connected to the outlet ends of the cylinders 40 via a plurality of ink supply hoses 51. Each of the ink tanks 50 is detachably installed using a mounting unit so that an empty ink tank 50 can be replaced with a new one. An ink tank sensor 52 is provided on each of the mounting units, detects whether an ink tank 50 is installed in the mounting unit, and outputs a signal to the control unit.

A valve 53 is installed in each of the ink supply hoses 51 that connect the ink tanks 50 to the outlet ends of the cylinders 40. The valve 53 may be configured as a one-way valve, such as an ON/OFF valve or a check valve. An ink sensor 54 is provided in each of the ink supply hoses 51 at a position between the ink tank 50 and the valve 53, and detects whether ink remains in the ink supply hose 51. When the ink sensor 54 detects that no ink remains in the ink supply hose 51, this means that the ink tank 50 associated with the ink supply hose 51 has been emptied. In the above case, the user replaces the empty ink tank 50 with a new one.

The air compression pump 60 is connected to the inlet ends of the cylinders 40 through the air hose 61. A first auxiliary tank 62 is installed on the air hose 61 at a position behind the outlet port of the air compression pump 60, with a pressure sensor 63 provided in the first auxiliary tank 62 to detect pressure in the tank 62. The first auxiliary tank 62 temporarily stores therein pressurized air output from the air compression pump 60 and regulates the air pressure prior to supplying the air under regulated pressure to the cylinders 40. An ON/OFF valve 64 is installed in the air hose 61 at a position behind the outlet port of the first auxiliary tank 62, and controls the flow rate of the pressurized air supplied to the cylinders 40. Of course, the ON/OFF valve 64 may be installed in the first auxiliary tank 62 in place of the air hose 61.

The vacuum pump 70 is connected to the inlet ends of the cylinders 40 through a first vacuum hose 71*a*. In the same manner as that described for the air compression pump 60, a second auxiliary tank 72 is installed on the first vacuum hose 71*a* at a position behind the outlet port of the vacuum pump 70 and temporarily stores therein low pressure air output from the vacuum pump 70, with both a pressure sensor 73 provided in the second auxiliary tank 72 to detect the pressure in the tank 72 and an ON/OFF valve 74 installed in the first vacuum hose 71*a* at a position behind the outlet port of the second auxiliary tank 72. The second vacuum hose 71*b*, which will be described later herein, branches from the first vacuum hose 71*a* at the second auxiliary tank 72.

When vacuum pressure generated by the vacuum pump 70 is provided to the cylinders 40 through the first vacuum hose 71*a*, the pistons move in the cylinders 40 toward the inlet ends of the cylinders 40. Thus, different colors of ink are drawn from the ink tanks 50 into the cylinders 40. In the above case, the ink flow control valves 43 installed in the ink injection hoses 41 must be closed so that the vacuum pressure can be provided only to the ink tanks 50 and not be provided to the ink cartridge 1. If the ink flow control valves 43 are configured as one-way valves, it is not necessary to additionally control the operation of the valves 43.

The vacuum pump 70 is also connected to the ink suction holes 32 of the connection unit 30 through the second vacuum hose 71*b*. Thus, during the operation of the vacuum pump 70, air and ink in the ink cartridge 1 can be drawn toward the vacuum pump 70 through the second vacuum hose 71*b*.

An ON/OFF valve 75 is installed in the second vacuum hose 71*b*. At a position behind the ON/OFF valve 75, the second vacuum hose 71*b* branches into three branch hoses which are connected to the three ink suction holes 32, respectively. A one-way valve 76 is installed in each of the three branch hoses of the second vacuum hose 71*b* to ensure the stable operation of the refill system. Of course, the number of branch hoses of the second vacuum hose 71*b* may be changed according to the number of colors of ink to be injected into the ink cartridge 1.

A drain hose 81 extends from the second auxiliary tank 72 to a waste ink drain tank 80 so that waste ink, drawn from the ink cartridge 1 through the second vacuum hose 71*b* by the vacuum pressure generated from the vacuum pump 70, can be drained to the drain tank 80. An ON/OFF valve 82 is installed in the drain hose 81 and opens or closes the drain hose 81 to control the waste ink drainage operation.

An ink cartridge refill device 90, which embodies the ink cartridge refill system according to the embodiment of the present invention, will be described herein below with reference to FIGS. 11 and 12.

Figure 11:
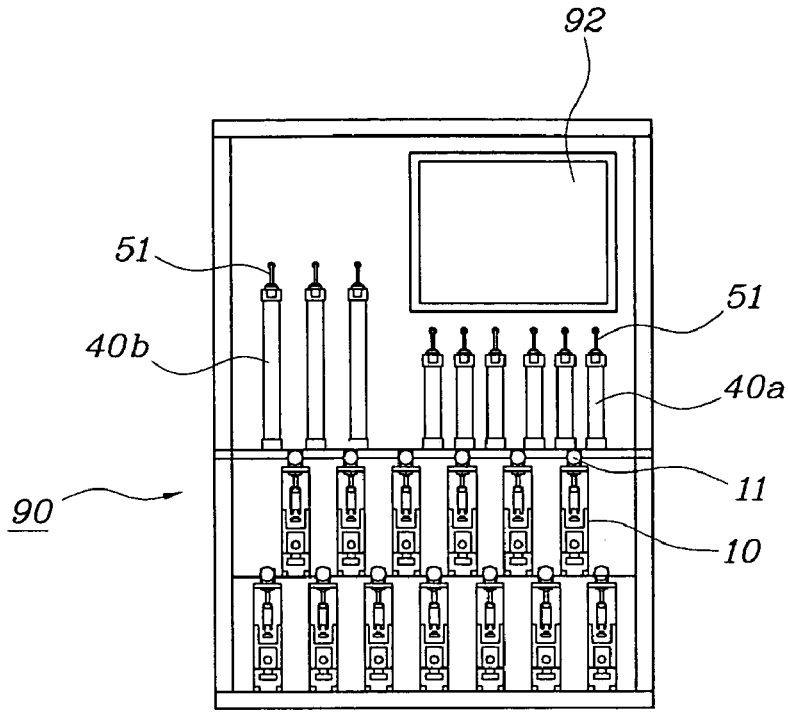
FIG. 11 is a front view illustrating an ink cartridge refill device which embodies the ink cartridge refill system according to the embodiment of the present invention.
Figure 12:
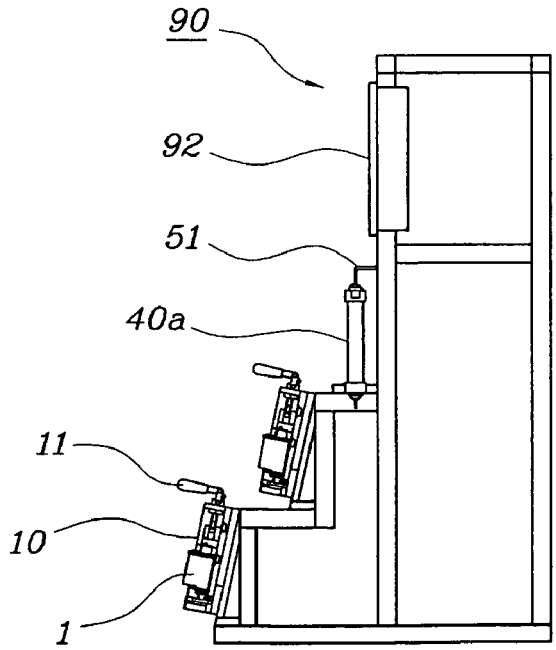
FIG. 12 is a side view of the ink cartridge refill device shown in FIG. 11.

As shown in FIGS. 11 and 12, a plurality of cartridge loading units 10 is installed on a plurality of stepped shelves of the device 90. A plurality of cylinders 40 is installed on an upper shelf above the stepped shelves having the cartridge loading units 10. The shorter cylinders 40*a*, placed in the right-hand section of the device 90 in FIG. 11, are the cylinders to temporarily store different color inks therein. The longer cylinders 40*b*, placed in the left-hand section of the device 90 in FIG. 11, are the cylinders to temporarily store black ink therein. The ink supply hoses 51 and the ink injection hoses (not shown) are neatly arranged on the back of the device 90.

The information, input from the above-mentioned sensors and elements, is transmitted to the control unit which analyzes the input information and displays the operational status of the refill device 90 on a touch screen 92. The user of the refill device inputs command signals using the touch screen 92.

In the embodiment of FIGS. 11 and 12, the refill device is configured such that the nozzles of the ink cartridges are directed downwards. However, it should be understood that the refill device may be designed differently from the above-mentioned arrangement, according to the design of the shelves.

Herein below, a method of refilling ink cartridges using the refill device according to the embodiment of the invention will be described with reference to FIGS. 5 through 12. However, it should be understood that the order of the steps is not limited to the following description.

[Loading of Cartridge]

After completely loading an ink cartridge 1 in a cartridge loading unit 10, the handle 11 is rotated upwards to bring the nozzles 2 of the cartridge 1 into close contact with the ink injection part 20.

[Suction of Waste Ink from Cartridge]

Waste ink is drawn from the ink cartridge 1 through the second vacuum hose 71*b* by operating the vacuum pump 70. This step is executed when necessary. In the above case, the valves 74 and 82 must be closed if the valves 74 and 82 are configured as ON/OFF valves.

[Injection of Ink into Cartridge]

The air compression pump 60 is operated to supply pressurized air into the cylinders 40 through the air hose 61, so that the ink stored in the cylinders 40 can be injected into the cartridge 1 through the ink injection hoses 41. In the above case, the valves 53 must be closed if the valves 53 are configured as ON/OFF valves.

[Suction of New Ink from Ink Tanks into Cylinders]

The vacuum pump 70 is operated to provide vacuum pressure to the cylinders 40 through the first vacuum hose 71*a*, so that ink stored in the ink tanks 50 can be supplied to the cylinders 40. In the above case, the valves 43, 75 and 82 must be closed if the valves 43, 75 and 82 are configured as ON/OFF valves.

[Regulation of Inner Pressure of Refilled Cartridge]

The vacuum pump 70 is operated to draw predetermined small amounts of air and ink from the refilled cartridge 1 through the second vacuum hose 71*b*, so that the inner pressure of the refilled cartridge 1 can be regulated. In the above case, the valves 74 and 82 must be closed if the valves 74 and 82 are configured as ON/OFF valves.

As described above, the present invention provides an ink cartridge refill system for inkjet printers which removes predetermined small amounts of air and ink from a refilled ink cartridge and regulates the inner pressure of the cartridge after an ink cartridge refill process has been completed, and which can completely remove remaining ink from the cartridge at the initial stage of the ink cartridge refill process when necessary.

Furthermore, the refill system can remove remaining ink from both the ink injection holes and the gap defined between the nozzles of the ink cartridge and the ink injection holes after the ink cartridge refill process has been completed.

In addition, the refill system can be operated simply by manipulating a control button, and allows a user to manage the ink cartridge refill process while viewing a touch screen on which the entire process of refilling the ink cartridge is displayed.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An ink cartridge refill system, comprising:

a cartridge loading unit to load an ink cartridge therein, with an ink injection hole provided in the cartridge loading unit and communicating with a nozzle of the ink cartridge when the cartridge is securely loaded in the cartridge loading unit, wherein the ink injection hole is formed in an ink injection part which is in close contact with the nozzle of the ink cartridge, the ink injection part being detachably mounted to the cartridge loading unit, wherein the cartridge loading unit is configured such that a particular model of ink cartridge is loaded in the cartridge loading unit, and wherein the cartridge loading unit is provided with a sensor to detect whether an ink cartridge is loaded in the cartridge loading unit;

an ink tank to store refill ink therein;

a cylinder provided with an air pressure-actuated piston therein, thus receiving ink from the ink tank through an ink supply hose and supplying the ink to the ink injection hole through an ink injection hose;

a compression pump connected to the cylinder through an air hose, thus providing a compression force to the piston;

a vacuum pump connected to the cylinder through a first vacuum hose, thus providing a suction force to the piston, and connected to the ink injection hole through a second vacuum hose, thus drawing ink from the ink cartridge;

a connection unit to connect both the ink injection hose and the second vacuum hose to the ink injection hole, wherein the connection unit comprises a body to be detachably mounted to the cartridge loading unit, with both an ink supply hole and an ink suction hole formed in the connection unit and joined together at a predetermined position to form an outlet port connected to the ink injection hole;

a first auxiliary tank placed between the compression pump and the cylinder and temporarily storing therein pressurized air output from the compression pump;

a second auxiliary tank placed between the vacuum pump and the cylinder and temporarily storing therein low pressure air output from the vacuum pump, wherein the ink supply hose to connect the ink tank to the cylinder is provided with an ON/OFF valve or a one-way valve, and the ink injection hose to connect the cylinder to the connection unit is provided with an ON/OFF valve or a one-way valve; and a sensor placed between the ink tank and the valve provided on the ink supply hose so that the sensor detects whether ink remains in the ink supply hose.

2. The ink cartridge refill system according to claim 1, wherein the second vacuum hose to connect the vacuum pump to the connection unit is provided with an ON/OFF valve.

3. The ink cartridge refill system according to claim 1, wherein the first auxiliary tank is provided with a first pressure sensor.

4. The ink cartridge refill system according to claim 1, further comprising:

an ON/OFF valve placed between the first auxiliary tank and the cylinder.

5. The ink cartridge refill system according to claim 1, wherein the second auxiliary tank is provided with a second pressure sensor.

6. The ink cartridge refill system according to claim 1, further comprising:

an ON/OFF valve placed between the second auxiliary tank and the cylinder.

7. The ink cartridge refill system according to claim 1, further comprising:

a waste ink drain tank connected to the second auxiliary tank through a drain hose.

8. The ink cartridge refill system according to claim 1, wherein the ink tank is detachably installed in a mounting unit so that the ink tank is replaceable with a new one, with an ink tank sensor being provided on the mounting unit and detecting whether an ink tank is installed in the mounting unit.

9. The ink cartridge refill system according to claim 1, wherein the cylinder is provided with a sensor to detect the amount of ink to be supplied to the ink cartridge through the ink injection hose.

10. The ink cartridge refill system according to claim 7, wherein the drain hose is provided with an ON/OFF valve.

* * * * *